United States Patent [19]

Cairo et al.

[11] 4,004,198

[45] Jan. 18, 1977

[54] PRIMARY CONTROL SYSTEM FOR FURNACES AND METHOD OF MAKING THE SAME

[75] Inventors: Anthony C. Cairo; Ronald E. Holkeboer, both of Holland, Mich.

[73] Assignee: Robertshaw Controls Company, Richmond, Va.

[22] Filed: June 18, 1975

[21] Appl. No.: 587,821

Related U.S. Application Data

[62] Division of Ser. No. 482,072, June 24, 1974, Pat. No. 3,905,748.

[52] U.S. Cl. ..... 317/155.5

[51] Int. Cl.[2] ..... H01H 47/00

[58] Field of Search ..... 317/155, 155.5, 157

[56] References Cited

UNITED STATES PATENTS

| | | | |
|---|---|---|---|
| 3,256,425 | 6/1966 | Deeg | 317/155.5 X |
| 3,325,695 | 6/1967 | Brunette et al. | 317/155 |
| 3,579,041 | 5/1971 | Paine | 317/155.5 X |

*Primary Examiner*—R. N. Envall, Jr.
*Attorney, Agent, or Firm*—Malcolm R. McKinnon

[57] ABSTRACT

An electrical primary control system for furnaces and method of making the same, the system comprising burner control means, an isolated low voltage control circuit and means for interfacing between the isolated low voltage control circuit and the burner control means; the interfacing means including a pair of resilient, magnetic reeds disposed within a hermetically sealed envelope, and a pair of electrically insulated independently wound coils having a differential in ampere turns and encompassing the envelope, the magnetic flux generated by such coils being additive whereby energization of both of the coils is required to close the contacts but energization of one of the coils is sufficient to maintain the contacts closed, at least one of the coils having a resistance wire of predetermined calibrated resistance electrically connected in parallel circuit therewith.

1 Claim, 9 Drawing Figures

PRIMARY CONTROL SYSTEM FOR FURNACES AND METHOD OF MAKING THE SAME

This is a division of application Ser. No. 482,072, filed June 24, 1974, now U.S. Pat. No. 3,905,748.

BRIEF SUMMARY OF THE INVENTION

This invention relates to primary control systems for furnaces and methods of making the same, and, more particularly, to an improved electrical primary control system and improved method of making the same, the system incorporating improved control circuitry effective to control and supervise a furnace burner.

Heretofore, primary controls have been utilized to control and supervise burners in furnaces, such primary controls controlling the furnace burner in response to a low voltage separate thermostat, usually located in the living space of a dwelling or other building, and supervising the furnace burner to insure safe combustion in the furnace's combustion chamber and shutting the burner off if an unsafe condition occurs. In primary controls of the indicated character, electromagnetic coil type switches have also been utilized heretofore, such switches being operable upon the concurrent emergization of a plurality of electrical circuits to complete one or more additional electrical circuits in an electrical network. Such a network is illustrated, for example, in the copending application of Frederick T. Bauer, Ser. No. 421,557, filed Dec. 4, 1973 entitled "Primary Control System for Furnaces" and assigned to the assignee of the present invention, and wherein an electromagnetic coil switch is utilized for interfacing between an isolated low voltage control network, having a plurality of concurrently energizable electrical circuits, and a furnace burner circuit.

However, in the mass production of such primary controls, the effectiveness of the ampere turns of the switches inherently varies from unit to unit in sequential production of such primary controls with the result that it has been necessary to provide a potentiometer in the control circuits in which the switches are incorporated in order to insure proper calibration of the switch and safe operation of the control.

An object of the present invention is to provide an improved primary control system for furnaces incorporating improved means for controlling the opening and closing of electrical contacts incorporated in the system.

Another object of the invention is to provide an improved method of making a control system for furnaces.

Another object of the invention is to provide an improved primary control system for furnaces and an improved method of making the same whereby concurrent energization of a plurality of circuits effects closure of switch contacts embodied in the system with improved fidelity and the energization of only a single circuit is effective to maintain closure of the contacts.

Another object of the invention is to provide an improved primary control system for furnaces that is economically and commercially feasible to manufacture, assemble and test with mass production labor and methods and which is durable, efficient and reliable in operation.

Another object of the invention is to provide an improved primary control system for furnaces which does not require the use of calibration potentiometers in the circuitry, thereby reducing the cost thereof.

Another object of the invention is to provide an improved primary control for furnaces incorporating improved control means which assures fail-safe operation of the unit and the associated circuitry.

Still another object of the invention is to provide an improved method of making a primary control for furnaces with a minimum expenditure of time, labor and expense.

The above as well as other objects and advantages of the present invention will become apparent from the following description, the appended claims and the accompanying drawings.

DETAILED DESCRIPTION

Figure 1:
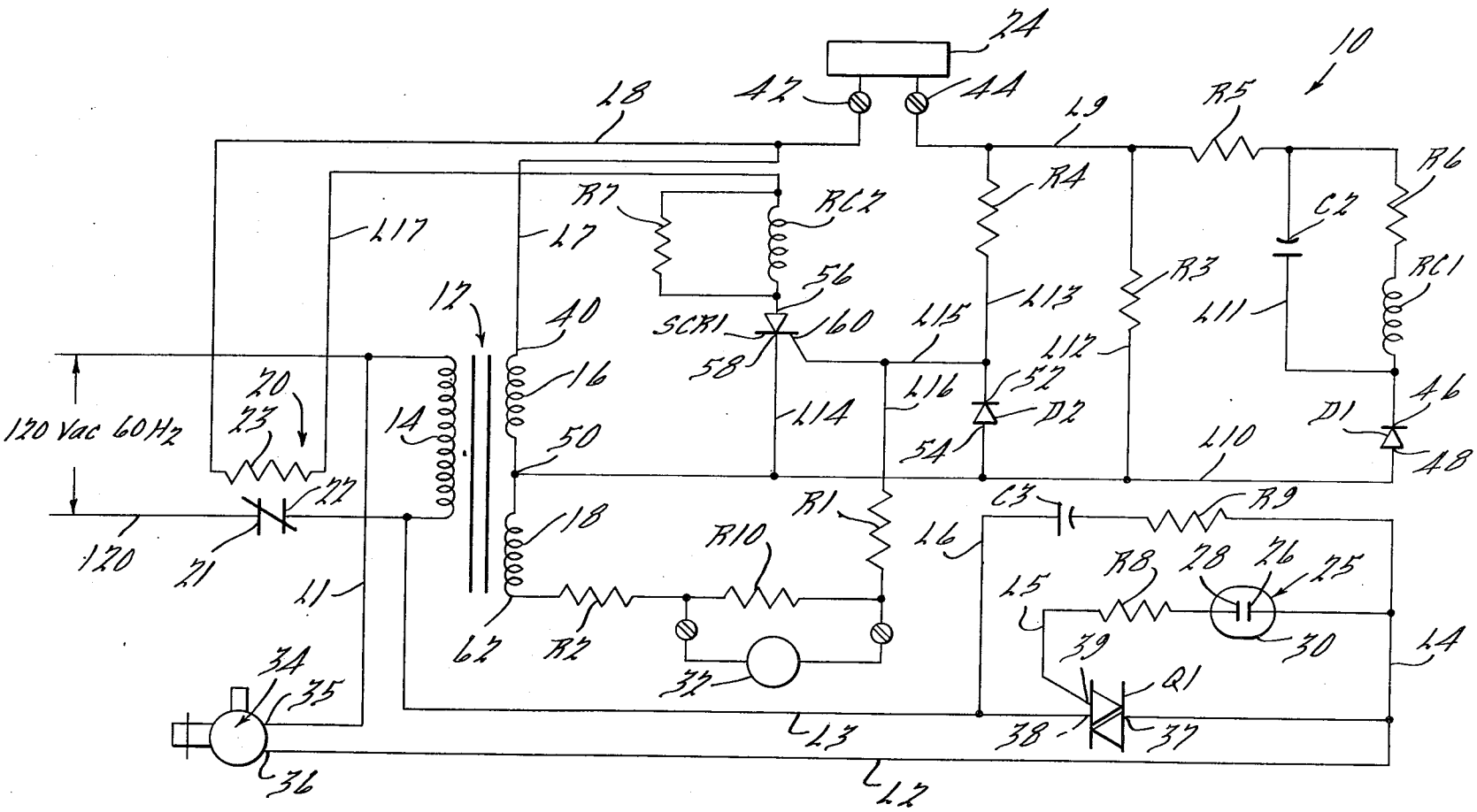
FIG. 1 is a schematic circuit diagram of an electrical primary control system embodying the present invention.

Referring to the drawings, and more particularly to FIG. 1 thereof, the circuitry for an electrical primary control system, generally designated 10, embodying the present invention is schematically illustrated therein. As shown in FIG. 1, the primary control system 10 is comprised of a step down transformer 12 having a primary winding 14 and secondary windings 16 and 18, the primary winding 14 being adapted to be connected to a conventional source of 120 volt alternating current while, in the embodiment of the invention illustrated each of the secondary windings 16 and 18 of the isolated step-down transformer preferably has a potential of approximately 8 volts AC. The primary control 10 also includes a line voltage safety switch, generally designated 20 including normally closed contacts 21 and 22 and a heater coil 23; a conventional thermostat generally designated 24, a reed switch, generally designated 25, having contacts 26 and 28 and independent, concentrically wound coils RC1 and RC2, the contacts 26 and 28 being enclosed within a hermetically sealed glass envelope 30 while the coils RC1 and RC2 are concentrically wound therearound; a triac Q1 and a silicon controlled rectifier SCR1. The primary control system 10 also includes a cadmium sulfide flame detector 32 resistors R1, R2, R3, R4, R5, R6, R8, R9 and R10, capacitors C2 and C3; a resistance wire R7, which will be described hereinafter in greater detail, and diodes D1 and D2. As shown in FIG. 1, the primary control system 10 is connected to and adapted to control and supervise a conventional burner 34 of a furnace (not shown). The terminal 35 of the burner 34 is connected to the source of power by the lead L1 while the terminal 36 of the burner is connected to the terminal 37 of the triac Q1 by the lead L2, the terminal 38 of the triac Q1 being connected to the source of power by the lead L3. The contact 26 of the reed switch 25 is connected by the lead L4 to the lead L2 while the contact 28 is connected to the gate 39 of the triac Q1 through the resistor R8 by the lead L5, the resistor R9 and capacitor C3 being connected across the leads L2 and L3 by the leads L4 and L6 to protect the triac Q1.

The normally closed contacts 21 and 22 of the safety switch 20 are connected to and adapted to make and break the high voltage lead 120 connected to the primary winding 14 of the transformer 12.

The terminal 40 of the secondary winding 16 is connected to the heater coil 23 of the safety switch 20 and to the terminal 42 of the thermostat 24 by the leads L7 and L8, the terminal 44 of the thermostat 24 being connected by the lead L9 through the resistors R5 and R6 and the coil RC1, to the terminal 46 of the diode D1. The terminal 48 of the diode D1 is connected to the center tap 50 of the secondary windings of the transformer 12 by the lead L10. The capacitor C2 is connected across the resistor R6 and the coil RC1 of the reed switch 25 by the lead L11 while the resistor R3 is connected between the leads L9 and L10 by the lead L12 as illustrated in FIG. 1 The terminal 44 of the thermostat 24 is also connected to the terminal 52 of the diode D2 by the lead L13 through the resistor R4, the terminal 54 of the diode D2 being connected to the center tap 50 of the transformer 12 by the lead L10. As shown in FIG. 1, the heater coil 23 of the safety switch 20 is connected to the terminal 56 of the silicon controlled rectifier SCR1 through the coil RC2 of the reed switch 25 by the lead L17, the resistance wire R7 being connected across the coil RC2. The terminal 58 of the silicon controlled rectifier SCR1 is connected to the center tap of the transformer 12 by the leads L14 and L10 while the gate 60 of the rectifier SCR1 is connected to the terminal 52 of the diode D2 by the lead L15 and to the terminals of the secondary winding 18 of the transformer by the lead L16 through the resistor R1, the cadmium sulfide flame detector 32 and the resistor R2, the resistor R10 being connected across the flame detector 32 and functioning to stabilize the silicon controlled rectifier SCR1.

Figure 2:
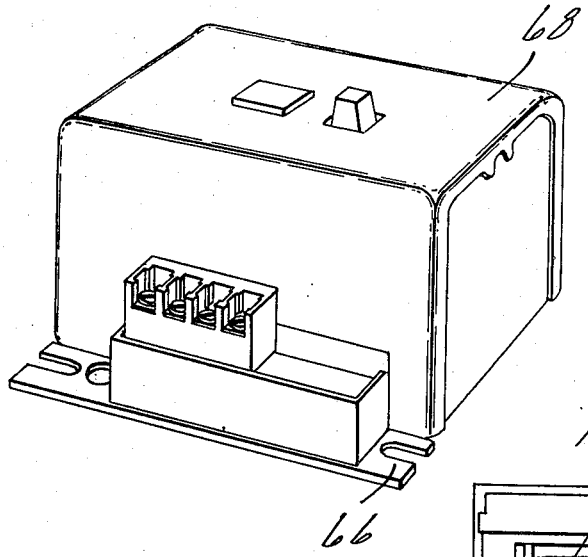
FIG. 2 is a perspective view of a primary control structure embodying the present invention.
Figure 3:
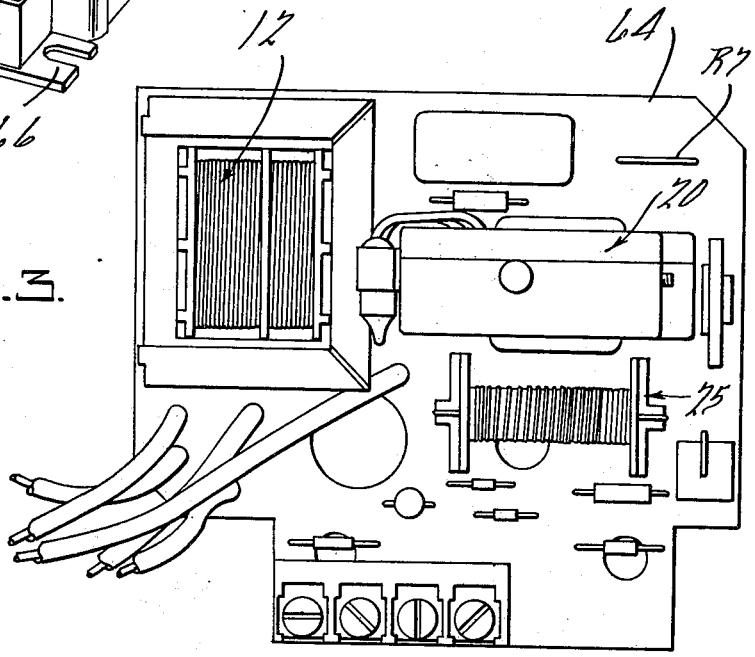
FIG. 3 is a top view of the circuit board of the primary control illustrated in FIG. 2, showing the components of the circuit illustrated in FIG. 1 assembled thereon.
Figure 4:
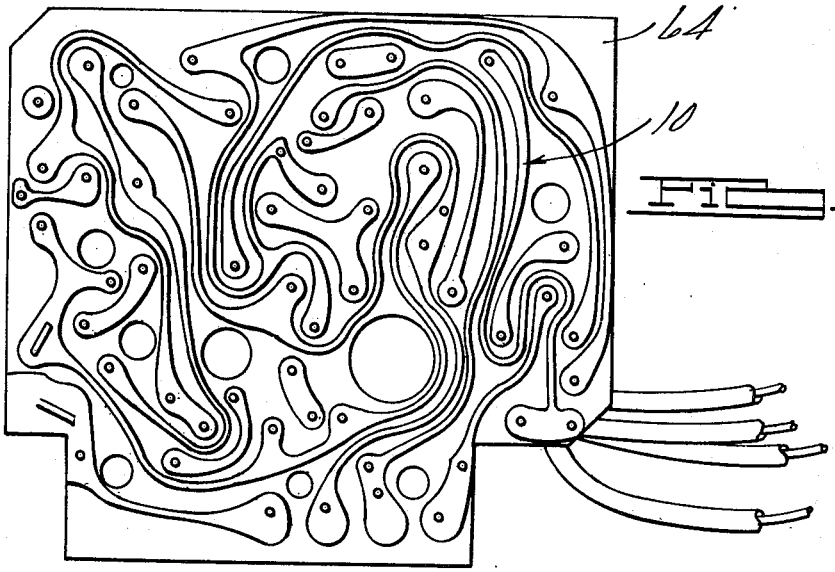
FIG. 4 is a bottom view of the structure illustrated in FIG. 3 and indicating the circuitry embodied thereon.

The above described components are preferably mounted on one side of a circuit board 64 as illustrated in FIG. 3, and the entire circuit structure is integrated as by soldering as illustrated in FIG. 4. In use, the circuit board 64 is mounted on a base 66 and disposed within a housing 68 carried by the base 66, as illustrated in FIG. 2.

Referring in greater detail to the components of the system 10, the rectifier SCR1 is a conventional silicon controlled rectifier and may, for example, carry a rating of approximately four amperes, while the thermostat 24 may be of any desired or conventional construction.

As illustrated in FIG. 5, 6, 7 and 8, the switch 25 includes the envelope 30 which may be formed of glass or other suitable non-magnetic material. A pair of flexible, resilient, magnetizable reels 70 and 72 are provided which are hermetically sealed within the envelope 30, the reeds 70 and 72 having low electrical and magnetic impedance and being composed of any suitable resilient, magnetizable material such as iron or iron-nickel alloys. The envelope 30 is preferably filled with a non-corrosive gas such as helium, neon or argon. In the embodiment of the invention illustrated, the contact portions 26 and 28 of the reeds 70 and 72, respectively, disposed inside the envelope 30 are cantilever suspended from the opposite ends of the envelope in substantially parallel relationship, the contact portion 28 of the reed 72 being slightly offset from the plane of the contact portion 26 of the reed 70 and terminating in spaced overlapping relationship with respect to the portion 26 of the reed 70 so as to define a contact gap therebetween. If desired, the overlapping contact portions 26 and 28 of the reeds 70 and 72, respectively, may be coated or impregnated with a suitable substance to insure good electrical contact characteristics. The portions 74 and 76 of the reeds 70 and 72, respectfully, project outwardly from the opposite ends of the envelope 30 and function as terminals for the external electrical circuits hereinbefore illustrated and described.

Figure 5:
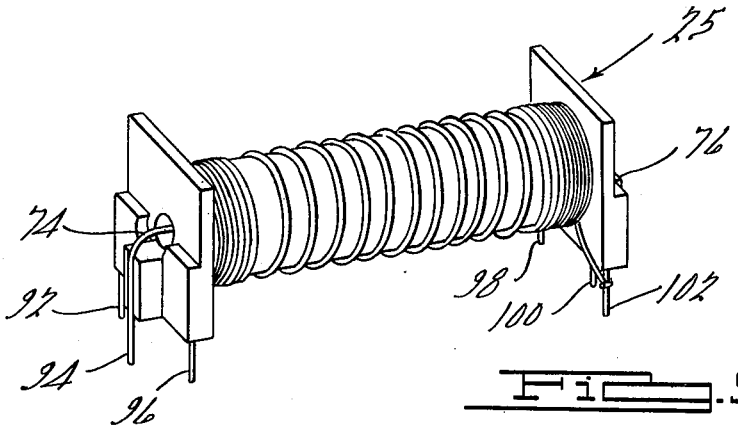
FIG. 5 is a perspective view of an electro magnetic switch incorporated in the system illustrated in FIG. 1, showing the same removed from the structure illustrated in FIG. 3.
Figure 6:
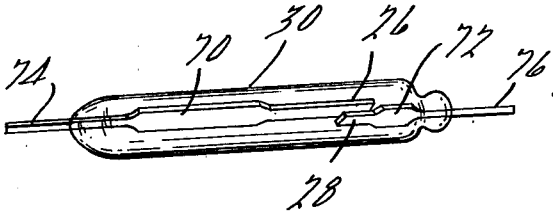
FIG. 6 is a perspective view of the reed switch incorporated in the structure illustrated in FIG. 5, showing the same removed therefrom.
Figure 7:
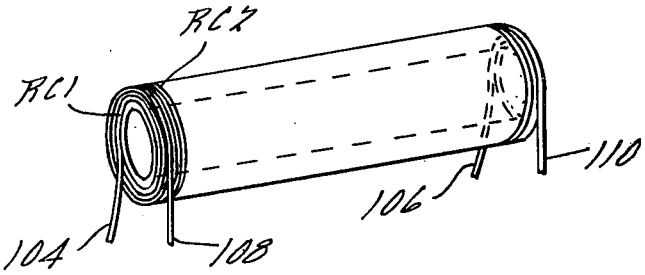
FIG. 7 is a perspective view of the coil structure embodied in the switch illustrated in FIG. 5, showing the same removed thereform.
Figure 8:
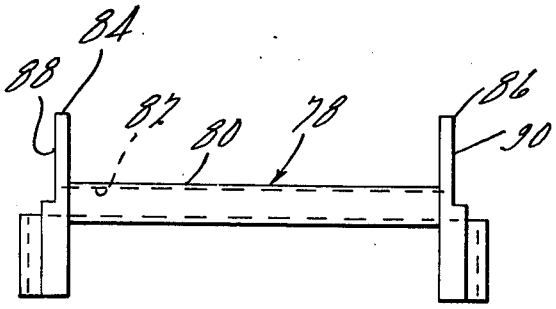
FIG. 8 is a side elevational view of the spool structure incorporated in the switch illustrated in FIG. 5, showing the same removed therefrom.
Figure 9:
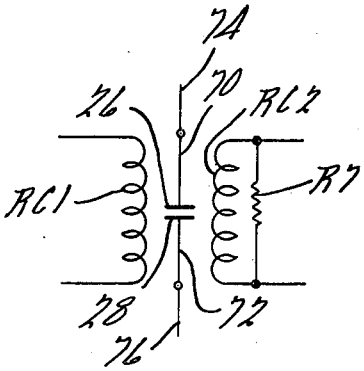
FIG. 9 is a schematic circuit diagram of the switch illustrated in FIG. 5.

The switch 25 also includes a support spool, generally designated 78, which is preferably formed of a suitable non-magnetic material, such as polyethylene, the support spool 78 having a tubular central portion 80 defining a bore 82 which is open at each end. The support spool 78 also includes a pair of flange portions 84 and 86 which are disposed at opposite ends of the tubular portion 80 and integrally connected therewith. As shown in FIG. 5, when the switch 25 is assembled, the envelope 30 is disposed within the bore 82 defined by the tubular portion 80 of the spool 78, the end portions 74 and 76 of the reeds 70 and 72, respectively, projecting outwardly beyond the end surfaces 88 and 90 of the flange portions 84 and 86, respectively, of the support spool 78.

The pair of electrically insulated, independently wound, concentric coils RC1 and RC2 are wound concentrically around the tubular portion 80 of the spool 78 between the flange portions 84 and 86 of the spool, the coils RC1 and RC2 encompassing the envelope 30 and the reeds 70 and 72 and being wound so that the magnetic flux generated thereby are additive when in phase. The number of ampere turns of the inner coil RC1 are such that the maximum flux generated by the coil RC1 is below that required to close the contact portions 26 and 28 of the reeds 70 and 72 but the flux generated by the coil RC1 is sufficient to hold the contacts 26 and 28 closed once pull-in has been established. The coil RC2, on the other hand, generates sufficient flux when combined with the coil RC1 to pull-in the reed switch and close the contacts 26 and 28 but the coil RC2 does not generate sufficient flux to pull-in the contacts 26 and 28 in the absence of concurrent energization of the coil RC1. By way of example, if the spring characteristics of the reeds 70 and 72 are such that the reeds will pull-in and close the contact portions 26 and 28 thereof with the magnetic flux generated by about 60 ampere turns but will not open the contacts because of the reduction of the reluctance at the gap between the contacts after the contacts close until the flux is reduced to below that generated by twenty ampere turns, a ratio of more than three to one is established. In accordance with the present invention, in the mass production of the switch, the coil RC2 is initially wound with a closely approximate desired number of ampere turns whereby the magnetic flux induced in the reeds 70 and 72 by the coil RC2 amounts to one-third of the magnetic flux required to close the contact portions 26 and 28 of the reeds while the coil RC1 is wound with sufficient ampere turns so that the magnetic flux induced in the reeds by the coil RC1 amounts to two-thirds of the magnetic flux required to close the contact portions 26 and 28 of the reeds. Thereafter, with the system 10 energized, in order to insure proper calibration of the coil RC2, which can be affected by the actual voltage drops across and values of the primary winding 14 and secondary winding 16 of the transformer 12, the coils RC1 and RC2, the rectifier SCR1 and capacitor C2, the voltage across the coil RC2 is measured by suitable instrumentation to determine the required resistance which must be connected across the coil RC2 in parallel circuit therewith whereby the effective number of ampere turns at minimum desired operating voltage will cause the contacts 26 and 28 to close. A length of resistance wire R7, such as nichrome wire, calibrated by length in ohms per inch is then cut to the required length and electrically welded or otherwise connected to the opposite end terminals of the coil RC2. It will be understood that the calibrated resistance wire R7 is accurately measured so that the effective length between the end terminals of the coil has the desired resistance, sufficient excess length being initially provided on the resistance wire to effect the connections at the end terminals of the coil RC2. With such a contruction, concurrent energization of both of the coils RC1 and RC2 at a preselected minimum voltage is required to close the contacts 26 and 28 while continued energization of one of the coils RC1 or RC2 maintains closure of the contacts 26 and 28. Deenergization of both of the coils RC1 and RC2 concurrently effects opening of the contacts 26 and 28.

In the embodiment of the invention illustrated, electrical terminals 92, 94, 96, 98, 100, and 102 are provided which are embedded in the flange portions 84 and 86 of the mounting spool 78 as illustrated in FIG. 5. The terminals 92 and 98 are electrically connected to the opposite ends 104 and 106 of the coil RC1 while the terminals 96 and 102 are electrically connected to the opposite ends 108 and 110 of the coil RC2, the calibrated resistance wire R7 being connected between the terminals 96 and 102 in parallel circuit with the coil RC2. The terminals 94 and 100 are electrically connected to the end portions 74 and 76, respectively, of the reeds 70 and 72. Such a construction facilitates mounting the switch 25 on the circuit board 64.

In the operation of the switch 25 the contact portions 26 and 28 of the reeds 70 and 72 are normally separated from each other. When sufficient magnetic flux is induced in the reeds 70 and 72, the reed contact portions 26 and 28 come together to make electrical contact therebetween, thereby electrically connecting the electrical external circuits connected to the terminal portions 94 and 100 of the switch 25.

As previously mentioned, the reeds 70 and 72 cannot be operated to close the contact portions 25 and 28 thereof by the energization of either the coil RC1 or the coil RC2 alone. When the coil RC1 alone is energized in a sense tending to actuate the switch, the magnetic flux generated by the current flowing in the winding of the coil RC1 will be induced in the reeds 70 and 72. This flux will be insufficient to close the contact portions 26 and 28. However, when the coil RC2 is energized while the energization of the coil RC1 is maintained, the flux induced in the reeds by the coil RC2 is additive with the flux generated by the coil RC1 and the contact portions 26 and 28 close thereby reducing the reluctance of the gap between the contacts to substantially zero so that the spring characteristics of the reeds 70 and 72 cannot overcome the flux generated either of the coils RC1 and RC2 and the contact portions 26 and 28 remain closed upon deenergization of one of the coils RC1 or RC2 while energization of the other such coils is maintained. However, upon concurrent deenergization of both the coil RC1 and the coil RC2, the contact portions 26 and 28 open due to the spring characteristics of the reeds 70 and 72 to deenergize the electrical circuit connected therethrough.

If either of the coils RC1 or RC2 become open or short circuited, or if the voltage applied to the coil RC2 falls below a predetermined minimum, such as 90 volts, such factors will prevent the reed switch from pulling in and closing the contacts 26 and 28, thus assuring fail-safe operation of the switch 25.

From the foregoing, it willl be apparent that the present invention eliminates the necessity of providing a potentiometer for use in conjunction with the switch 25 thereby reducing the cost of the circuitry associated with such switch and increasing the reliability of operation thereof.

Since the reed switches are very fast, they are capable of following an alternating current voltage to open or close 60 or 120 times per second. to avoid this opening and closing and the associated wear, the diode D1 and the capacitor C2 are provided. The diode D1 is preferably a 200 milliampere diode which supplies half wave rectified current to the capacitor C2 to establish a DC supply for the reed switch coil RC1. The capacitor C2 is preferably a 47 microfarad 15 volt DC capacitor. The diode D1 and the capacitor C2 function to form a DC supply for the holding coil RC1 so that flux is always present on the coil RC1 when the thermostat calls for heat. This flux is very small however. With such a construction and since relatively small current passes through the contacts 26 and 28, such contacts are very reliable over a relatively long life.

The triac Q1 is a bidirectional thyrister which may be gate triggered from a blocking to conducting state for either polarity of applied voltage, and is preferably mounted to isolate the other components of the system 10 from the heat generated by the triac Q1. The resistors R1 and R2 are preferably carbon resistors having ratings of 150 ohms and 560 ohms, respectively, one-half watt, the purpose of the resistor R1 being to prevent the accidental destruction of the diode D1, transformer 12 or the silicon controlled rectifier SCR1 by a serviceman in the field. In this connection the resistors R1, R2, R5, R9 and R10, the diode D2 and the capacitor C3 are all provided for the purpose of protecting other components and to protect against erroneous wiring in the field. The resistors R1, R2, R5 R9 and R10, the diode D2 and the capacitor C3 are thus not essential to the basic circuit performance.

Typical values for the components in the control system described above are as follows:

| | |
|---|---|
| SCR1 | 4AMP Silicon controlled rectifier |
| D1 | 200 Ma diode |
| D2 | 200 Ma diode |
| R1 | Carbon resistor 150 ohms, ± 20%, ½ watt |

-continued

| | |
|---|---|
| R2 | Carbon resistor 560 ohms, ± 20%, ½ watt |
| R3 | Wirewound resistor 20 ohms, ± 20%, 5 watt |
| R4 | Carbon resistor 3300 ohms, ± 20%, ½ watt |
| R5 | Carbon resistor 47 ohms, ± 20%, ½ watt |
| R6 | Wirewound resistor 680 ohms, ± 20%, 1 watt |
| R7 | Nichrome wire, calibrated ohms per inch |
| R8 | Carbon resistor 82 ohms, ± 20%, ½ watt |
| R9 | Carbon resistor 82 ohms, ± 20%, ½ watt |
| R10 | Carbon resistor 33000 ohms, ± 20%, ½ watt |
| C2 | Capacitor 47 mfd 15 VDC |
| C3 | Capacitor 22 mfd 200 V Mylar foil |

It will be understood, however, that these values may be varied depending upon the particular application of the principles of the present invention.

The safety switch 20 may be of any desired or conventional construction, as for example, a conventional bi-metallic switch, in which at least one of the contacts 21 or 22 is carried by a bimetallic member and in which energization of the heater coil 23 is effective to open the contacts 21 and 22 by heating the bimetallic member for a predetermined period of time.

Assuming a basic knowledge of the triac Q1, the silicoa controlled rectifier SCR1, and the cadmium sulfide flame detector 32, a typical thermostat cycle operates in the following manner. It should be noted initially that whenever the reed contacts 26 and 28 are closed, current will flow from the source of electric power through the lead L1, the burner 34, the lead L2, the contacts 26 and 28 and the resistor R6, to the gate of the triac Q1 and the lead L3. When the gate of the triac Q1 is energized the full motor current will then pass through the triac Q1. This starts the burner and has the same effect as closing a set of relay contacts between the lead L2 and the lead L3.

Whenever the thermostat contacts close, a continuous holding flux is established in the coil RC1 by the DC supply network comprised of the diode D1 and the capacitor C2. Current also flows through the resistor R4 to the gate 60 of the silicon controlled rectifier SCR1. If the cadmium sulfide flame detector 32 registers darkness, no current can be shunted away from the gate 60 of the silicon controlled rectifier SCR1 and SCR1 will conduct. When SCR1 conducts, current also passes through the pull-in coil RC2 of the reed switch 25 and the heater 23 of the safety switch 20. With a flux established in the coil RC2 and the coil RC1, the reed switch contacts 26 and 28 will pull-in and the triac Q1 will start the burner. If the cadmium sulfide flame detector 32 does not register flame, the silicon controlled rectifier SCR1 will continue to conduct and the safety switch 20 will open the contacts 21 and 22 due to the heating action of the heater 23. It is preferred that the contacts 21 and 22 open and lock out after approximately 15 seconds. If the cadmium sulfide flame detector registers flame, then the flame detector 32 decreases in resistance and shunts current away from the gate 60 of the rectifier SCR1. SCR1 will no longer conduct, the heating coil 23 of the contacts 27 and 28. If the cadmium cell 32 registers flame and for some reason the flame should go out during the thermostat cycle, the rectifier SCR1 will again conduct and the heating coil 23 will be energized so as to open the contacts 21 and 22 into a lock-out condition. When the thermostatic conditions are satisfied and the contacts thereof open, the coil RC1 is denergized thereby opening the contacts 26 and 28 and also deenergizing the triac Q1. No current is then available through the resistor R4 to energize SCR1 even though the cadmium cell 32 registers no flame. It should also be understood that the same cycle would occur if the thermostat were connected to line voltage and placed in one leg of the transformer primary coil.

An important aspect of the above described circuitry resides in the fact that if there is a failure in the circuitry, the system will fail in safe condition. For example, if the silicon controlled rectifier SCR1 is shorted from anode to cathode it will conduct electric current supplied by the secondary winding 16 of the transformer. The cadmium sulfide flame detector 32 will have no effect on the control circuit. Since current through the rectifier SCR1 must also pass through the safety switch heater 23, the safety switch contacts 21 and 22 will open into a lock-out condition. The only way to start the burner again is by re-setting the safety switch. An open circuit in the rectifier SCR1 will render the control circuit inoperative since no starting current is provided in the coil RC2. The burner will thus never start. A short circuit from the gate to the cathode of the rectifier SCR1 has the same effect as an open circuit between the anode and cathode of SCR1. An open circuit from the gate to cathode of the rectifier SCR1 also has this effect.

Failure of the diode D1 in the short circuit state causes AC voltage to appear across the capacitor C2 and since AC voltage is destructive to the capacitor C2 it will generally cause it to fail short circuited. Hence, there is no coil power to the reed switch coil RC1 and the reed switch is incapable of holding. The burner would then become inoperative. If the diode D1 fails open circuited, there is likewise no power to the coil RC1 and the burner becomes inoperative.

A short circuit failure of the diode D2 reacts the same as a gate to cathode short of the rectifier SCR1 as previously described. An open circuit failure of the diode D2 will generally be destructive to the rectifier SCR1 and any failure of the SCR1 will render the control circuit inoperative as previously described.

An open or short circuit failure of the capacitor C2 will prevent the reed switch 25 from pulling in and the burner from operating. The burner will also be prevented from operating of the coils RC1 or RC2 become open or short circuited since such failure will prevent the reed switch from pulling in and closing the contacts 26 and 28.

The resistor R1 prevents accidental destruction of the diode D2 by a serviceman in the field. This could happen if a serviceman accidentally shorted one of the thermostat terminals with the proper terminal of the cadmium sulfide flame detector 32. Open circuit failure would react in the same manner as an open circuit in the flame detector 32. Short circuit of either of the resistors R1 of R2 would simply eliminate the protection measure from the equipment.

The resistor R3 is a wire would type so that short circuit failure can be neglected. Open circuit failure of the resistor R3 would result in elimination of thermostat bias current used for conventional thermostat "pre-heaters". The resistor R3 plays no role in the circuit other than for this home comfort feature.

Continuing the description of the fail-safe operation, the resistor R4 is utilized for the purpose of calibrating the cadmium sulfide flame detector 32. If the resistor R4 is open circuited then SCR1 never receives current from gate to cathode and will never turn on. Since the rectifier SCR1 must conduct to pull in the reed switch through the coil RC2, the burner will never turn on. If the burner is in the middle of a cycle when the resistor R4 fails open, then the burner will fail to start on the next cycle. If the resistor R4 fails in a short circuit condition, then neither of the coils RC1 or RC2 will be energized and the reed switch contacts will not close so that the burner will be inoperative.

The resistor R5 protects the diode D1 from current surges to the capacitor C2 during normal operation. If the resistor R5 were to short circuit then the diode D1 may fail shorted and the burner would become permanently inoperative in the manner previously described in connection with the failure of the D1. If the resistor R5 fails open circuited, then no power will be furnished to the coil RC1 and the reed switch contacts will not close. The burner would then be inoperative.

The resistor R6 functions to limit the power to the coil RC1. The resistor R6 is calibrated and calibrates the coil RC1 to within specified drop-out range for the reed switch. As is well known, wire wound resistors do not fail short. If open circuit failure results, then no power is supplied to the coil RC1 and the reed switch will not pull in. The burner will thus be inoperative if the resistor R6 fails open circuited.

As previously described, the resistance wire R7 is used to calibrate the pull in voltage of the reed switch. This is accomplished by shunting current away from the reed switch coil RC2. An open circuit in the resistance wire R7 allows the reed switch to pull in at lower line voltage than the set point voltage, as for example 90 volts. Short circuit of the resistance wire R7 prevents power from flowing to the reed switch coil RC2 and the reed switch will not close the contacts 26 and 28. The burner will then be inoperative.

The heating coil of the safety switch 20 cannot fail shorted. An open circuit failure functions in the same manner as an open circuit failure of the anode to cathode on the rectifier SCR1 previously described. With respect to the cadmium sulfide flame detector 32 protected by the resistor R10, this flame detector maintains approximately 1500 ohms at one foot candle illumination. Short circuit results in the failure to start the burner when the thermostat closes. An open circuit causes the safety switch 20 to lock out.

While a preferred embodiment of the invention and a preferred method of making the same have been illustrated and described, it will be understood that various changes and modifications may be made without departing from the spirit of the invention.

What is claimed is:

1. The method of making a primary control system for furnaces which comprises the steps of providing a pair of resilient magnetic contact members, winding a pair of electrically insulated concentric coils with said coils having a differential in ampere turns, disposing said coils in encompassing relationship with respect to said contact members, measuring the flux generating capacity of at least one of said coils when a predetermined voltage is applied thereto, measuring and severing a length of resistance wire having a predetermined resistance per unit of length whereby when said severed wire is connected in parallel circuit across said one coil both said coils will have a predetermined flux generating capacity at a predetermined voltage sufficient to actuate said contact members, and thereafter electrically connecting said severed resistance wire to the opposite ends of said one coil.

* * * * *